United States Patent [19]

Cooke

[11] 4,254,529

[45] Mar. 10, 1981

[54] PAINT-APPLYING ROLLER FRAME WITH PAINT DRIP CATCHING SHIELD

[75] Inventor: Donald R. Cooke, Minneapolis, Minn.

[73] Assignee: Padco, Inc., Minneapolis, Minn.

[21] Appl. No.: 69,321

[22] Filed: Aug. 24, 1979

[51] Int. Cl.[3] ..... B05C 17/02

[52] U.S. Cl. ..... 15/230.11; 15/248 A; D4/38.1

[58] Field of Search ..... 15/230.11, 248 A; D4/38.1; D28/7

[56] References Cited

U.S. PATENT DOCUMENTS

| | | | |
|---|---|---|---|
| D. 235,278 | 6/1975 | Janssen | D4/38.1 |
| D. 252,219 | 6/1979 | Peebles | D28/7 |
| 2,896,244 | 7/1959 | Crosh | 15/248 A |
| 3,029,458 | 4/1962 | Balicki | 15/230 |
| 3,058,145 | 10/1962 | Hegedus . | |
| 3,112,729 | 12/1963 | Prezioso, Jr. | 15/230 |
| 3,115,659 | 12/1963 | Church | 15/230.11 |
| 3,274,637 | 9/1966 | Schulze . | |
| 3,378,872 | 4/1968 | Frontera et al. | 15/230.11 |
| 3,538,532 | 11/1970 | Shortino et al. | 15/248 A X |
| 3,748,683 | 7/1973 | Smith et al. | 15/248 A |
| 3,825,970 | 7/1974 | Hanssen | 15/248 A |
| 3,970,396 | 7/1976 | Brady | 15/230.11 X |
| 4,063,325 | 12/1977 | Lizak | 15/230.11 |

FOREIGN PATENT DOCUMENTS

| | | | |
|---|---|---|---|
| D. 37175 | 10/1973 | Canada | 15/248 A |

*Primary Examiner*—Edward L. Roberts

*Attorney, Agent, or Firm*—Kinney, Lange, Braddock, Westman and Fairbairn

[57] ABSTRACT

A paint applying roller apparatus includes a frame having a paint roller shield and a handle with a paint roller rotatably attached to a pair of end portions integral with the shield. When the frame is in an inverted position, both the handle and the shield have portions that allow the frame to rest on a substantially horizontal surface with the paint roller above the shield. The shield has an outer edge that intercepts a vertical plane tangent to the paint roller for catching any dripping paint from the paint roller.

3 Claims, 4 Drawing Figures

PAINT-APPLYING ROLLER FRAME WITH PAINT DRIP CATCHING SHIELD

BACKGROUND OF THE INVENTION

1. Field of the Invention

The present invention relates to an improved paint-applying roller apparatus having a spray shield and handle. In particular, the present invention relates to an improved paint-applying roller apparatus that when placed in an inverted position has a shield that will catch any paint dripping from the paint roller.

2. Description of the Prior Art

In the past, both shielded and unshielded paint-applying roller frames had to be placed back into the paint pan when the user wanted to set the paint roller down, causing an inconvenience if the paint pan was not near. Also, setting the paint-applying roller apparatus in a paint pan that has just recently been filled with paint causes an excessive amount of paint to cling to the roller, causing a further inconvenience.

U.S. Pat. No. 3,825,970 shows such a shielded paint-applying roller. The paint-applying roller apparatus in U.S. Pat. No. 3,825,970 protects the user from spattering paint while painting, but has to be placed back into the paint pan when the user wants to set the apparatus down. The apparatus cannot be placed on the ground or floor without dripping paint or leaving an imprint.

There is a need for a paint-applying roller apparatus that allows the user to set the apparatus down anywhere and not necessarily in the paint pan.

SUMMARY OF THE INVENTION

The paint-applying roller apparatus of the present invention includes a frame with a shield having a pair of end portions rotatably attached to a paint roller and a handle integral with the shield. When the frame is placed in an inverted position, both the handle and the shield have portions that allow the frame to rest on a substantially horizontal surface with the paint roller above the shield. The shield has an outer edge that intercepts a vertical plane tangent to the paint roller for catching any paint dripping from the roller.

The shield and handle are molded as one piece from a synthetic polymer, preferably polypropylene, making the paint-applying roller apparatus substantially lighter than other rollers of the prior art. The polypropylene end portions of the shield are sufficiently flexible to allow the paint roller to be popped out of rotatable engagement with the end portions. The one-piece construction also eliminates most of the sharp angles and recesses of prior art rollers, facilitating clean-up of the apparatus. The integral shield/handle structure of the present invention permits conventional use, including the conventional loading of paint onto the roller as well as the conventional motion of the device over the working surface.

DETAILED DESCRIPTION OF THE PREFERRED EMBODIMENTS

Figure 1:
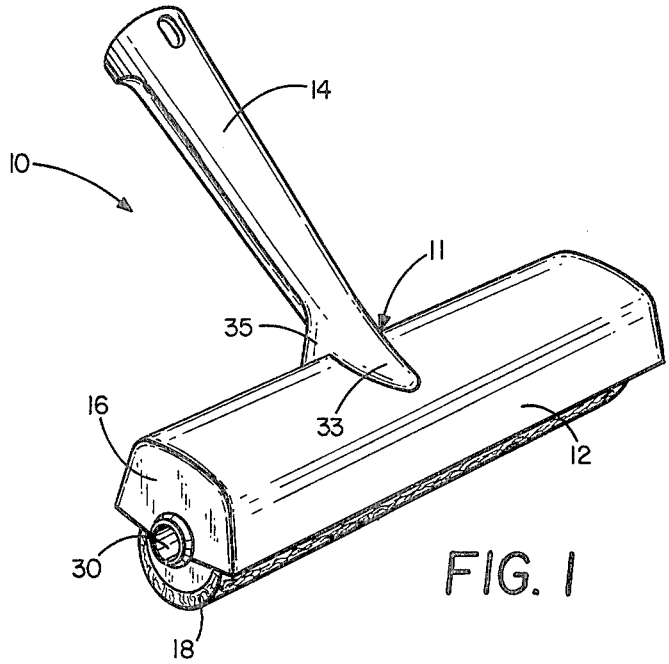
FIG. 1 is a perspective view of the paint-applying apparatus of the present invention.

The paint-applying roller apparatus of the present invention is generally indicated at 10 in FIG. 1 and includes a frame 11 with an integral shield 12 and handle 14. The shield 12 has integral end portions 16, to which a paint-applying roller 18 is rotatably attached. The shield covers approximately fifty percent of the outer surface of the paint roller to prevent paint spatter. The handle 14 and the shield 12 are molded as a one-piece unit from a synthetic polymer, preferably polypropylene.

Figure 3:
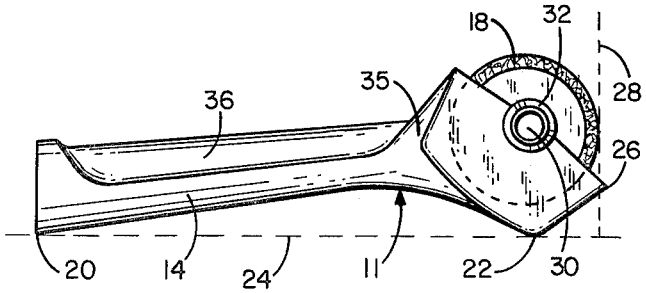
FIG. 3 is an inverted side view showing the present invention's ability to catch dripping paint from the paint roller.
Figure 4:
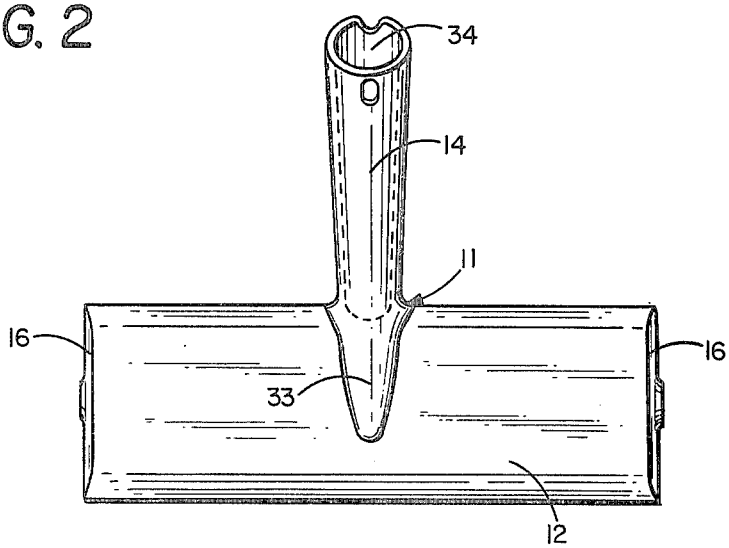
FIG. 4 is a top view showing the recess within the handle of the paint-applying apparatus.

The frame 11, when in an inverted position as shown in FIG. 3, rests stably in a substantially horizontal position on handle portion 20 and shield portion 22, which touch a horizontal surface 24. The shield has an edge 26 that intercepts a vertical plane 28. The vertical plane 28 represents the outermost path that paint can drip from the paint roller 18. With the edge 26 intercepting the vertical plane 28, the dripping paint from the paint roller 18 will fall into the inverted shield 12.

The rotatably attached paint roller 18 is rotatably attached by frictionally engaging a pair of end caps such as those described in U.S. Pat. No. 3,825,970. The end caps have projecting ends or hubs 30 which rotatably engage the apertures 32 in each portion 16. Unlike the prior art device, however, the present invention uses a hub 30 having a diameter of about one-half inch (an increase in size of about sixty percent). This substantially reduces wear at bearing points between hubs 30 and apertures 32. With the end portion 16 molded from polypropylene, the rotatably attached paint roller 18 may be released from its rotatably engaged position by bending the flexible polypropylene end portion 16 and disengaging the projecting end 30 from the aperture 32.

Another embodiment of the present invention has the paint roller 18 mounted on a coaxial shaft that has two end portions which frictionally engage the inner surface of the paint roller. The shaft has projecting ends which also rotatably engage apertures in the end portion 16 of the shield. The paint roller 18 in this embodiment is similarly disengaged by pushing on the flexible end portions 16 in opposite directions.

As shown in the Figures, a gusset portion 33 and web bracing portions 35 provide strength to the intersection of handle 14 and shield 12. A recess 34 is molded through the entire length of handle 14. The recess is tapered inwardly to frictionally engage an extension pole (not shown) eliminating the need for a conventional cumbersome threaded recess. A portion 36 of handle 14 below axis 38 is preferably provided with a molded texture surface to facilitate gripping the frame 11.

Figure 2:
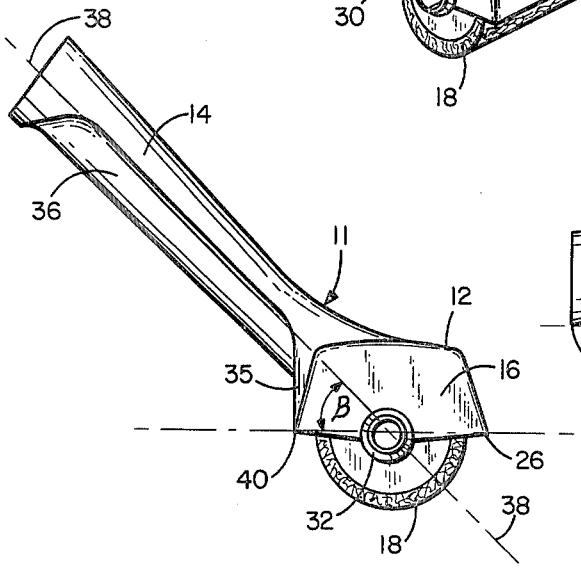
FIG. 2 is a side view of the paint-applying apparatus.

As illustrated in FIG. 2, the axis 38 of the handle 14 forms an angle $\beta$ with a plane defined by a pair of parallel edges 26, 40 of the shield 12. $\beta$ preferably ranges between about 40° to about 50° for comfortable use of the apparatus on a working surface. In the preferred embodiment shown in the Figures, $\beta$ is about 45°.

In use, the present invention may be used as a conventional roller, applying paint on a surface with shield 12 catching any paint spatter from roller 18. When the user needs to set down the paint-applying roller apparatus for only a brief period of time, such as to clean up a paint drop or readjust a drop cloth, the apparatus may be inverted and placed anywhere since the shield 12 will catch any paint dripping from paint roller 18. The paint drip catching shield 12 eliminates the inconvenience of having to place the apparatus in the paint pan if the pan is any distance from the user. Further, the present invention allows the user to avoid placing the apparatus into a full paint pan thereby avoiding an oversaturated paint roller.

In addition, the present invention provides several other distinct improvements and advantages over the prior art shielded roller apparatus such as shown in U.S. Pat. No. 3,825,970. First, the present invention is substantially lighter than the prior art devices. The one-piece molded structure of the present invention eliminates the need for thickened connections and weighty metal connectors. The frame 11 of the present invention is substantially lighter than the prior art devices while providing the necessary strength and even greater durability. Strength is achieved by means of thin tubular configurations such as handle 14, which is hollow through entirely its entire length. Additional strength is provided by gusset portion 33 and web bracing portions 35 rather than by thicker eye-shaped cross-sections used in the prior art shielded roller devices.

Second, the present invention is substantially easier to use with extension poles. The tapered recess in handle 14 provides a frictional engagement and holding of an extension pole. The prior art threaded connectors used to connect the shielded roller to the extension pole and were cumbersome and often difficult to use. The present invention is substantially simpler to use, while securely holding the pole.

Third, the present invention is substantially easier to clean. The one-piece molded construction of the present invention eliminates most sharp angles and recesses found in the prior art devices. This greatly facilitates easier cleaning.

Fourth, the substantially larger hub size used in the present invention reduces wear significantly at bearing points. This increases the life of the frame 11 of the present invention.

Fifth, the present invention is particularly well adapted for use of standard nine inch roller covers. This permits the present invention to be used with a wide range of conventional roller cover naps including texture roller covers.

It will be appreciated that although polypropylene is the preferred material of construction, other materials may be used as long as they are light-weight, durable and resistant to etching or damage from solvents or ordinary oil base paints, and are capable of being molded to form a unitary shield/handle structure. The shield 12 can also be made to accommodate a wide variety of diameters of paint rollers with a coaxial arrangement being preferred in order to extend the range of diameters of paint rollers which may be received between the end portions of the shield. Further, although the present invention has been described with reference to the preferred embodiment, persons skilled in the art will recognize that changes may be made in form and detail without departing from the spirit and scope of the invention.

What is claimed is:

1. A paint applying roller apparatus comprising:

a paint roller;

a frame for rotatably engaging the paint roller, the frame comprising an integral paint roller shield and handle; wherein the shield includes a top, first and second ends, and front and rear sides having essentially parallel lower edges which define a plane and having essentially parallel upper edges connected to front and rear edges of the top, respectively; wherein the handle is substantially straight, is connected to the shield at the connection of the upper edge of the rear side and the rear edge of the top, and has a longitudinal axis which forms an angle of intersection of between about 40° and about 50° with the plane defined by the lower edges of the front and rear sides; and roller mounting means for rotatably attaching the paint roller to the first and second ends of the shield to permit rotation of the paint roller about an axis essentially parallel to the lower edges and lying essentially in the plane defined by the lower edges; and wherein the handle has a length such that when the frame is in an inverted position, the frame stably rests on a rear end of the handle and on a portion of the shield formed from the connection of the front edge of the top and the upper edge of the front side with the shield positioned below the paint roller to intercept vertical planes tangent to the paint roller and thus to catch any dropping paint therefrom.

2. The apparatus of claim 1 wherein the handle has a tapered recess extending through essentially the handle's entire length for receiving and frictionally engaging an extension pole.

3. A paint applying apparatus for use in combination with a paint roller, the apparatus comprising:

a paint roller shield for rotatably engaging and for surrounding approximately fifty percent of the outer surface of the paint roller, the shield including a top, first and second ends, and front and rear sides, wherein the front and rear sides have essentially parallel lower edges which define a plane and have essentially parallel upper edges which are connected to the front and rear edges, respectively, of the top;

means for rotatably mounting the paint roller to the first and second ends of the shield to permit rotation of the paint roller about an axis essentially parallel to the lower edges of the front and rear sides and aligned essentially in the plane defined by the lower edges;

a substantially straight handle integrally molded with the shield, the handle being connected to the shield proximate the connection of the rear edge of the top and the upper edge of the rear side and extending rearward from the shield, wherein the shield has a longitudinal axis which forms an angle of intersection of between about 40° and about 50° with the plane defined by the lower edges of the front and rear sides; and wherein when the apparatus is in an inverted position, the apparatus stably rests on a rear end of the handle and on the shield at the connection of the front edge of the top and the upper edge of the front side with the shield positioned below the paint roller to intercept vertical planes tangent to the paint roller and thus to catch any dropping paint therefrom.

* * * * *